US010678155B2

(12) United States Patent
Terui et al.

(10) Patent No.: US 10,678,155 B2
(45) Date of Patent: Jun. 9, 2020

(54) TONER COMPRISING A SURFACE LAYER OF AN ORGANOSILICON POLYMER PROTRUSION

(71) Applicant: CANON KABUSHIKI KAISHA, Tokyo (JP)

(72) Inventors: Yuhei Terui, Numazu (JP); Noriyoshi Umeda, Suntou-gun (JP); Tomonori Matsunaga, Suntou-gun (JP); Shohei Kototani, Suntou-gun (JP); Masamichi Sato, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/508,662

(22) Filed: Jul. 11, 2019

(65) Prior Publication Data

US 2020/0026208 A1 Jan. 23, 2020

(30) Foreign Application Priority Data

Jul. 17, 2018 (JP) ..... 2018-134368

(51) Int. Cl.
*G03G 9/08* (2006.01)
*G03G 9/087* (2006.01)
(Continued)

(52) U.S. Cl.
CPC ..... *G03G 9/0819* (2013.01); *G03G 9/0821* (2013.01); *G03G 9/0827* (2013.01);
(Continued)

(58) Field of Classification Search
CPC . G03G 9/0819; G03G 9/0827; G03G 9/09307
(Continued)

(56) References Cited

U.S. PATENT DOCUMENTS 7,135,263 B2 11/2006 Kawakami et al.
7,611,813 B2 11/2009 Ida et al.
(Continued)

FOREIGN PATENT DOCUMENTS

JP 2001-075304 3/2001
JP 2008-257217 10/2008
(Continued)

OTHER PUBLICATIONS

U.S. Appl. No. 16/392,990, Noriyoshi Umeda, filed Apr. 24, 2019.
U.S. Appl. No. 16/509,886, Yasutaka Yagi, filed Jul. 12, 2019.

*Primary Examiner* — Mark A Chapman
(74) *Attorney, Agent, or Firm* — Venable LLP

(57) ABSTRACT

A toner comprising a toner particle that contains a toner base particle and an organosilicon polymer on a surface of the toner base particle, wherein the organosilicon polymer forms protruded portions with a prescribed structure on the surface of the toner base particle, and in the toner cross section, when the protrusion width w is the length of the segment where a protruded portion and the toner base particle form a continuous interface, the protrusion diameter D is the maximum length of a protruded portion, and the protrusion height H is the length from the peak of the protruded portion to the line along the circumference of the toner base particle surface, the numerical proportion of these protruded portions having a ratio D/w of the protrusion diameter D to the protrusion width w from 0.33 to 0.80, is a least 70 number %.

9 Claims, 4 Drawing Sheets

(51) Int. Cl.
*G03G 9/113* (2006.01)
*G03G 9/097* (2006.01)
*G03G 9/093* (2006.01)

(52) U.S. Cl.
CPC ..... *G03G 9/08755* (2013.01); *G03G 9/08793* (2013.01); *G03G 9/09307* (2013.01); *G03G 9/09708* (2013.01); *G03G 9/1136* (2013.01)

(58) Field of Classification Search
USPC ..... 430/110.2, 110.3
See application file for complete search history.

(56) References Cited

U.S. PATENT DOCUMENTS

| | | | |
|---|---|---|---|
| 7,767,370 | B2 | 8/2010 | Ishigami et al. |
| 8,043,781 | B2 | 10/2011 | Imafuku et al. |
| 8,105,743 | B2 | 1/2012 | Ishii et al. |
| 8,114,562 | B2 | 2/2012 | Ishigami et al. |
| 8,440,382 | B2 | 5/2013 | Isono et al. |
| 8,497,054 | B2 | 7/2013 | Sugiyama et al. |
| 8,652,725 | B2 | 2/2014 | Watanabe et al. |
| 8,652,737 | B2 | 2/2014 | Handa et al. |
| 8,778,581 | B2 | 7/2014 | Nonaka et al. |
| 8,916,319 | B2 | 12/2014 | Ikeda et al. |
| 8,940,467 | B2 | 1/2015 | Hashimoto et al. |
| 9,229,345 | B2 | 1/2016 | Ikeda et al. |
| 9,261,806 | B2 | 2/2016 | Moribe et al. |
| 9,285,697 | B2 | 3/2016 | Fukudome et al. |
| 9,632,441 | B2 | 4/2017 | Abe et al. |
| 9,658,551 | B2 | 5/2017 | Terui et al. |
| 9,785,068 | B2 | 10/2017 | Umeda et al. |
| 9,785,077 | B2 | 10/2017 | Abe et al. |
| 9,829,814 | B2 | 11/2017 | Yoshida et al. |
| 9,857,711 | B2 | 1/2018 | Yoshida et al. |
| 9,964,879 | B2 | 5/2018 | Terui et al. |
| 10,012,922 | B2 | 7/2018 | Yoshida et al. |
| 10,078,285 | B2 | 9/2018 | Kubo et al. |
| 10,295,922 | B2 | 5/2019 | Terui et al. |
| 10,303,074 | B2 | 5/2019 | Yamawaki et al. |
| 2016/0187799 | A1* | 6/2016 | Hiroshi ..... G03G 9/09775 430/108.7 |
| 2018/0329320 | A1 | 11/2018 | Yoshida et al. |
| 2018/0329332 | A1 | 11/2018 | Tominaga et al. |

FOREIGN PATENT DOCUMENTS

| | | |
|---|---|---|
| JP | 2009-036980 | 2/2009 |
| JP | 2017-138462 | 8/2017 |

* cited by examiner

TONER COMPRISING A SURFACE LAYER OF AN ORGANOSILICON POLYMER PROTRUSION

BACKGROUND OF THE INVENTION

Field of the Invention

The present invention relates to the toner for developing the electrostatic charge image used in image-forming apparatuses such as electrophotographic apparatuses, electrostatic printing apparatuses, and so forth.

Description of the Related Art

Laser printers and copiers are typical examples of electrophotographic system-based devices that use toner. In recent years, colorization has gone forward in dramatic fashion and qualitatively higher levels of image quality are being required. Improvements in transferability are an issue for toner-based electrophotography. For example, toner may remain on the photosensitive member (untransferred toner) when the toner image formed on the photosensitive member, i.e., the electrostatic image bearing member, is transferred to the transfer material during the transfer step.

Lowering the attachment force of the toner for the electrostatic image bearing member is generally known to be effective for improving the transferability of toner. Attaching an external additive to the toner particle surface is an example of means for lowering the attachment force of toner. In particular, in a method known for improving the transfer efficiency, the physical attachment force between the toner and electrostatic image bearing member is reduced by a spacer effect brought about by the addition of a spherical external additive having a large particle diameter.

However, while this is effective as a method for improving the transfer efficiency, spherical large-diameter external additives undergo migration, detachment, and burial due to long-term image output and are then unable to function as a spacer. As a consequence, it has been difficult to stably obtain the expected effect of improving the transfer efficiency.

A method is thus proposed in Japanese Patent Application Laid-open No. 2009-36980 in which external additive migration and detachment are suppressed by bringing about a semi-embedding of a large-diameter external additive.

Japanese Patent Application Laid-open No. 2008-257217, on the other hand, proposes a method in which detachment and burial are suppressed through the use of a large-diameter external additive having a hemispherical shape.

In order, in another vein, to achieve improvements in transferability by methods other than external addition, extensive investigations have also been carried out with respect to methods in which the toner particle surface is coated with an organosilicon compound.

As an example of the ideas in the art of coating the toner particle surface with a silicon compound, Japanese Patent Application Laid-open No. 2001-75304 discloses a method for producing a polymerized toner, the method being characterized by the addition of a silane coupling agent to the reaction system.

A method that uses the combination of a large-diameter external additive with a silane coupling agent is proposed in Japanese Patent Application Laid-open No. 2017-138462. This method has made it possible to control the roughness of the toner particle surface while immobilizing the large-diameter external additive on the toner particle surface with the silane coupling agent. As a result, migration, detachment, and burial of the large-diameter external additive can be suppressed and a high transferability can be expressed on a long-term basis.

SUMMARY OF THE INVENTION

By bringing about a semi-embedding of a large-diameter external additive, the invention in Japanese Patent Application Laid-open No. 2009-36980 enables the suppression of migration and detachment of the large-diameter external additive and thus provides for the long-term expression of the spacer effect. However, it has been found that burial in the latter half of durability testing is accelerated as a result of the semi-embedding.

In addition, the use of a hemispherically-shaped large-diameter external additive in accordance with Japanese Patent Application Laid-open No. 2008-257217 does suppress migration and burial of the large-diameter external additive and thus provides for the long-term expression of the spacer effect. However, it has been found that achieving a uniform immobilization of the large-diameter external additive on the toner particle surface with this method is problematic, and that as a consequence maintenance of the transfer efficiency-improving effect to accommodate further extension of the service life is problematic.

With both Japanese Patent Application Laid-open Nos. 2009-36980 and 2008-257217, it has also been found that a problem occurs with the uniformity of immobilization of the large-diameter external additive due to the use of dry external addition. Thus, in the case of Japanese Patent Application Laid-open No. 2009-36980, migration and detachment may not be completely suppressed and member contamination may be produced by the detached large-diameter external additive. Member contamination is also produced with Japanese Patent Application Laid-open No. 2008-257217 because the occurrence of migration and detachment is facilitated when the protruded portion of the hemispherical shape faces the toner particle surface.

With Japanese Patent Application Laid-open No. 2001-75304, on the other hand, a high transferability has not been obtained due to an inadequate coating by the silicon compound due to an inadequate amount of deposition of the silane compound on the toner particle surface.

With Japanese Patent Application Laid-open No. 2017-138462, it was found that, because the large-diameter external additive used is a sphere, the load received by the toner in the normal direction ends up being concentrated at a single point on the large-diameter external additive and a problem occurs with regard to the ability to resist burial. As a consequence, this is unsatisfactory in terms of obtaining additional increases in the service life.

An object of the present invention is to solve these problems. That is, the present invention provides a toner that exhibits a high transferability and that is resistant to changes even during long-term use and thus maintains a high transferability.

As a result of intensive investigations, the present inventors discovered that a toner that solves the aforementioned problems is obtained by forming protruded portions on the toner particle surface and by controlling the shape of these protruded portions.

Thus, the present invention relates to a toner that comprises a toner particle that contains a toner base particle and an organosilicon polymer on the surface of the toner base particle, wherein the organosilicon polymer has the structure given by formula (1) below;

the organosilicon polymer forms protruded portions on the surface of the toner base particle; and in a flat image provided by observing the toner cross section with a scanning transmission electron microscope STEM, drawing a line along the circumference of the toner base particle surface, and converting based on this line along the circumference, and assuming that the length of the line along the circumference for a segment where a protruded portion and the toner base particle form a continuous interface is taken as a protrusion width w, the maximum length of a protruded portion in the direction normal to the protrusion width w is taken as a protrusion diameter D, and the length, in the line segment that forms the protrusion diameter D, from the peak of a protruded portion to the line along the circumference is taken as a protrusion height H, the numerical proportion P(D/w), in protruded portions having a protrusion height H from 40 nm to 300 nm, of protruded portions having a ratio D/w of the protrusion diameter D to the protrusion width w from 0.33 to 0.80, is a least 70 number %.

$$R—SiO_{3/2} \quad (1)$$

In the formula, R represents an alkyl group having from 1 to 6 carbons or a phenyl group.

The present invention can thereby provide a toner that exhibits a high transferability and that is resistant to changes even during long-term use and thus maintains a high transferability.

Further features of the present invention will become apparent from the following description of exemplary embodiments with reference to the attached drawings.

DESCRIPTION OF THE EMBODIMENTS

Figure 1:
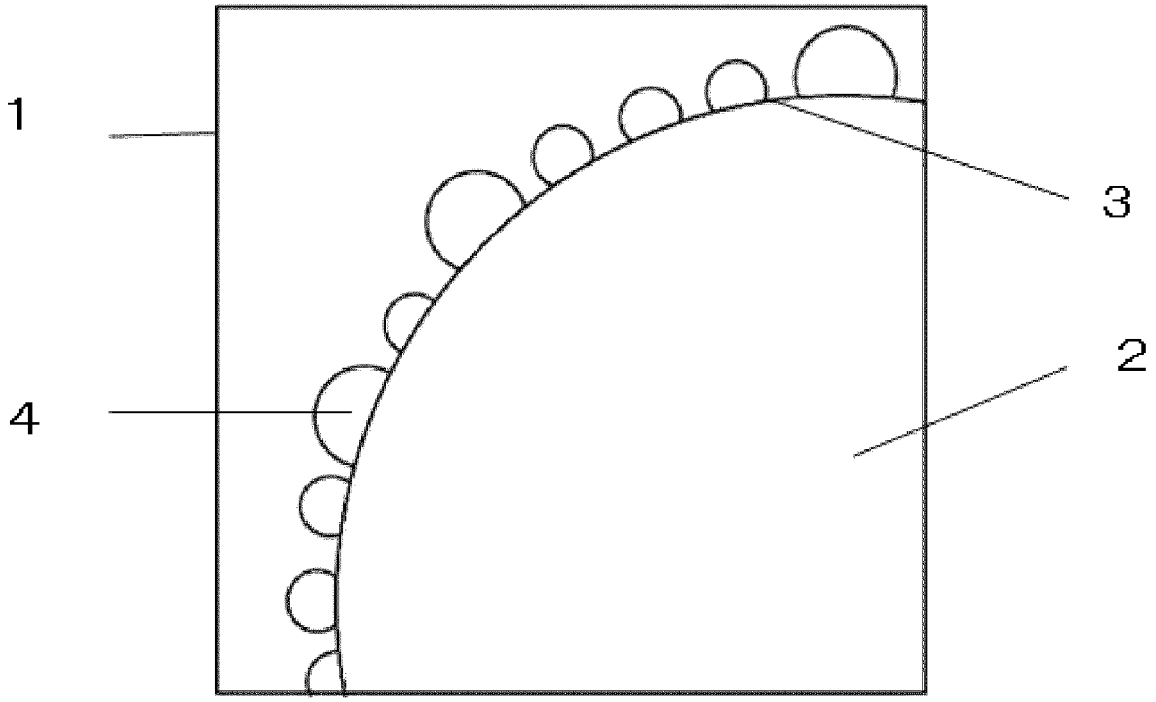
FIG. 1 is a schematic diagram of a toner cross section as observed with a STEM.

Embodiments of the present invention are described in the following, but the present invention is not limited to or by the following embodiments.

Unless specifically indicated otherwise, the expressions "from XX to YY" and "XX to YY" that show numerical value ranges refer in the present invention to numerical value ranges that include the lower limit and upper limit that are the end points.

The toner according to the present invention relates to a toner comprising a toner particle that contains a toner base particle and an organosilicon polymer on the surface of the toner base particle, wherein the organosilicon polymer has the structure given by formula (1) below;

the organosilicon polymer forms protruded portions on the surface of the toner base particle; and in a flat image provided by observing the toner cross section with a scanning transmission electron microscope STEM, drawing a line along the circumference of the toner base particle surface, and converting based on this line along the circumference, and assuming that the length of the line along the circumference for a segment where a protruded portion and the toner base particle form a continuous interface is taken as a protrusion width w, the maximum length of a protruded portion in the direction normal to the protrusion width w is taken as a protrusion diameter D, and the length, in the line segment that forms the protrusion diameter D, from the peak of a protruded portion to the line along the circumference is taken as a protrusion height H, the numerical proportion P(D/w), in protruded portions having a protrusion height H from 40 nm to 300 nm, of protruded portions having a ratio D/w of the protrusion diameter D to the protrusion width w from 0.33 to 0.80, is a least 70 number %.

$$R—SiO_{3/2} \quad (1)$$

In the formula, R represents an alkyl group having from 1 to 6 carbons or a phenyl group.

The conditions and requirements indicated above are described in detail in the following.

The toner according to the present invention has, on the toner particle surface, protruded portions containing an organosilicon polymer. These protruded portions are engaged in surface contact with the surface of the toner base particle. This surface contact can be expected to provide a substantial inhibitory effect on the migration, detachment, and burial of the protruded portions. STEM observations of the toner cross section were performed in order to show the degree of surface contact. FIG. 1 to FIG. 4 provide schematic diagrams of these protruded portions on a toner particle.

The 1 given in FIG. 1 is a STEM image. This image shows an approximately one-quarter section of a toner particle, wherein 2 is a toner base particle, 3 is the surface of the toner base particle, and 4 is a protruded portion. In FIG. 2 to FIG. 4, 5 is the protrusion width w, 6 is the protrusion diameter D, and 7 is the protrusion height H.

An image of the toner cross section is observed and a line is drawn along the circumference of the surface of the toner base particle. Conversion to a flat image is carried out based on this line along the circumference. In this flat image, the protrusion width w is taken to be the length of the line along the circumference of the segment where a protruded portion and the toner base particle form a continuous interface. The protrusion diameter D is taken to be the maximum length of a protruded portion in the direction normal to the protrusion width w, and the protrusion height H is taken to be the length, in the line segment that forms the protrusion diameter D, from the peak of the protruded portion to the line along the circumference.

Figure 2:
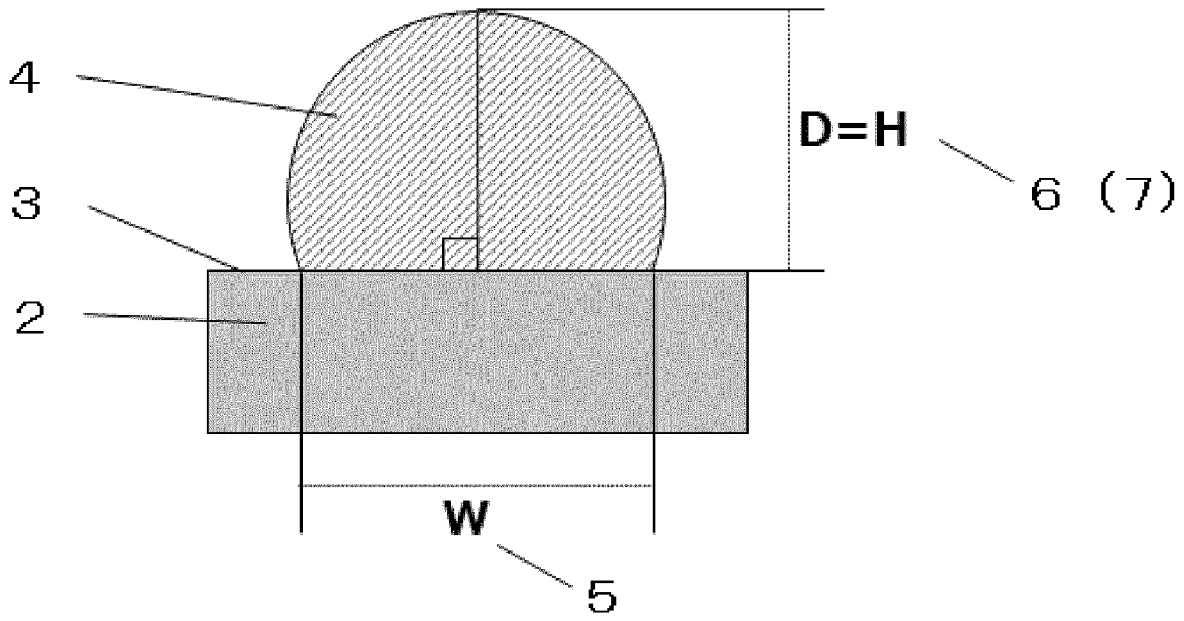
FIG. 2 is a schematic diagram that shows a methodology for measuring the protrusion shape on the toner.
Figure 3:
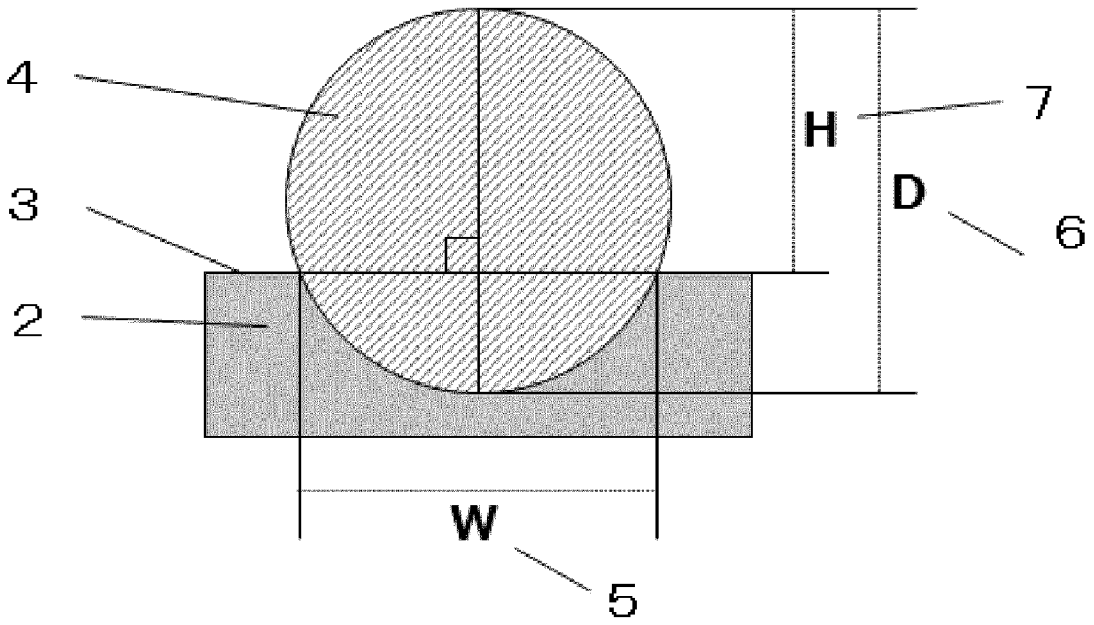
FIG. 3 is a schematic diagram that shows a methodology for measuring the protrusion shape on the toner.
Figure 4:
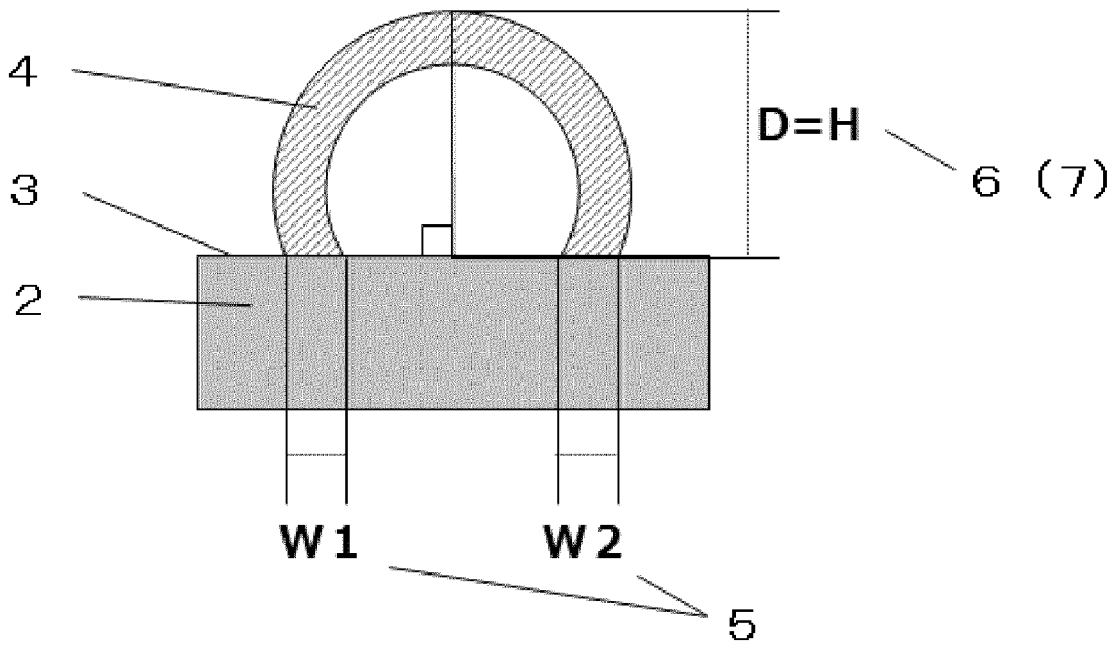
FIG. 4 is a schematic diagram that shows a methodology for measuring the protrusion shape on the toner.

The protrusion diameter D and the protrusion height H are the same in FIG. 2 and FIG. 4, while the protrusion diameter D is larger than the protrusion height H in FIG. 3.

FIG. 4 schematically shows the immobilized state for a particle resembling a bowl-shaped particle, in which the central part of a hemispherical particle is recessed, as obtained by crushing and dividing a hollow particle. In FIG. 4, the protrusion width w is the sum of the lengths of the organosilicon compound in contact with the surface of the toner base particle. The protrusion width w in FIG. 4 is thus the sum of W1 and W2.

It was discovered that the protruded portions are resistant to migration, detachment, and burial when, based on the definitions given above, the protrusion shape for the protruded portions of organosilicon compound has the ratio D/w of the protrusion diameter D to the protrusion width w from 0.33 to 0.80. That is, it was discovered that an excellent transferability capable of withstanding extensions of the service life is exhibited when the numerical proportion P(D/w), for protruded portions having a protrusion height H from 40 nm to 300 nm, of protruded portions having a ratio D/w from 0.33 to 0.80 is a least 70 number %.

The transferability is thought to be improved by the generation of a spacer effect between the toner base particle surface and the transfer member due to protruded portions of at least 40 nm. On the other hand, it is thought that a significant inhibitory effect on migration, detachment, and burial during a durability evaluation is exhibited due to protruded portions being not more than 300 nm.

It was found that, when the numerical proportion P(D/w) is a least 70 number % for the proportion for protruded portions from 40 nm to 300 nm, during durability testing a high inhibitory effect on member contamination is also exhibited while the transferability is maintained. P(D/w) is preferably at least 75 number % and is more preferably at least 80 number %. While there is no particular limitation on the upper limit, it is preferably not more than 99 number % and is more preferably not more than 98 number %.

In addition, in observation of the toner cross section using a scanning transmission electron microscope STEM, assuming that the width of the flat image (length of the line along the circumference of the toner base particle surface) is taken as a circumference length L and the sum of the protrusion widths w of the protruded portions having a protrusion height H from 40 nm to 300 nm of the protruded portions of the organosilicon polymer present in the flat image is taken as Σw, Σw/L is preferably from 0.30 to 0.90.

A better transferability and a better inhibitory effect on member contamination are provided when Σw/L is at least 0.30, and a superior transferability is provided when Σw/L is not more than 0.90. Σw/L is more preferably from 0.45 to 0.80.

The fixing ratio of the organosilicon polymer for the toner is preferably at least 80 mass %. A fixing ratio of at least 80 mass % facilitates a better persistence of the transferability and inhibitory effect on member contamination during extended use. The fixing ratio is more preferably at least 90 mass % and is even more preferably at least 95 mass %. The upper limit, on the other hand, is not particularly limited, but is preferably not more than 99 mass % and is more preferably not more than 98 mass %. This fixing ratio can be controlled through, for example, the following during the addition and polymerization of the organosilicon compound: the addition rate of the organosilicon compound, reaction temperature, reaction time, pH during the reaction, and timing of pH adjustment.

In addition, from the standpoint of providing an even better transferability, H80 is preferably at least 65 nm where, when a cumulative distribution of the protrusion height H is constructed for the protruded portions having a protrusion height H from 40 nm to 300 nm, H80 is the protrusion height corresponding to 80 number % for cumulation of the protrusion height H from the small side. At least 75 nm is more preferred. The upper limit is not particularly limited, but is preferably not more than 120 nm and is more preferably not more than 100 nm.

The number-average diameter for the protrusion diameter R is preferably from 20 nm to 80 nm where the protrusion diameter R is the maximum diameter of the organosilicon polymer protruded portion in observation of the toner with a scanning electron microscope SEM. From 35 nm to 60 nm is more preferred. The occurrence of member contamination is impeded in this range.

The toner contains an organosilicon polymer having the structure given by the following formula (1).

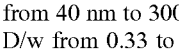

$$R—SiO_{3/2} \quad (1)$$

(In the formula, R represents an alkyl group having from 1 to 6 carbons or a phenyl group.)

In the organosilicon polymer having the structure represented by formula (1), one of the four valences of the Si atom is bonded to R and the remaining three are bonded to an O atom. The O atom resides in a state in which its two valences are each bonded to Si, thus providing a siloxane bond (Si—O—Si). Considering the Si atom and O atom at the level of the organosilicon polymer, they are represented by $—SiO_{3/2}$ since three O atoms are present for two Si atoms. The $—SiO_{3/2}$ structure of this organosilicon polymer is regarded as having properties similar to those of silica ($SiO_2$), which is constituted of a large number of siloxane bonds.

The R in the substructure given by formula (1) is preferably an alkyl group having 1 to 6 carbons and is more preferably an alkyl group having 1 to 3 carbons.

Preferred examples of the alkyl group having 1 to 3 carbons are the methyl group, ethyl group, and propyl group. R is more preferably the methyl group.

The organosilicon polymer preferably is a condensation polymer of an organosilicon compound having the structure given by the following formula (Z).

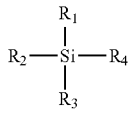

(Z)

(In formula (Z), $R_1$ represents a hydrocarbon group (preferably an alkyl group) having 1 to 6 carbons, and $R_2$, $R_3$, and $R_4$ each independently represent a halogen atom, hydroxy group, acetoxy group, or alkoxy group.)

$R_1$ is preferably an aliphatic hydrocarbon group having 1 to 3 carbons and is more preferably the methyl group.

$R_2$, $R_3$, and $R_4$ each independently represent a halogen atom, hydroxy group, acetoxy group, or alkoxy group (also referred to herebelow as a reactive group). These reactive groups undergo hydrolysis, addition polymerization, and condensation polymerization, thereby forming a crosslinked structure.

Hydrolysis proceeds gently at room temperature, and, from the standpoint of the deposition behavior onto the surface of the toner base particle, an alkoxy group having 1 to 3 carbons is preferred and the methoxy group and ethoxy group are more preferred.

The hydrolysis, addition polymerization, and condensation polymerization of $R_2$, $R_3$, and $R_4$ can be controlled using the reaction temperature, reaction time, reaction solvent, and pH. A single organosilicon compound having three reactive groups ($R_2$, $R_3$, and $R_4$) in the individual molecule, excluding the $R_1$ in the formula (Z) given above (also referred to as a trifunctional silane in the following), or a combination of a plurality of such organosilicon compounds, may be used in order to obtain the organosilicon polymer used in the present invention.

The following are examples of compounds with formula (Z):

trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane;

trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

To the extent that the effects of the present invention are not impaired, an organosilicon polymer may be used that is obtained using the following in combination with the organosilicon compound having the structure given by the formula (Z): an organosilicon compound having four reactive groups in each molecule (tetrafunctional silane), an organosilicon compound having two reactive groups in each molecule (difunctional silane), or an organosilicon compound having one reactive group (monofunctional silane). Examples thereof are as follows: dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, and 3-(2-aminoethyl)aminopropyltriethoxysilane, and trifunctional vinylsilanes such as vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

The content of the organosilicon polymer in the toner particle is preferably from 1.0 mass % to 10.0 mass %.

The following is an example of a preferred method for forming the protrusion shape as prescribed above on the toner particle surface: dispersing a toner base particle in an aqueous medium to obtain a toner base particle dispersion, and then adding the organosilicon compound and bringing about formation of the protrusion shape to yield a toner particle dispersion.

The solids fraction concentration in the toner base particle dispersion is preferably adjusted to from 25 mass % to 50 mass %. The temperature of the toner base particle dispersion is preferably adjusted in advance to at least 35° C. In addition, the pH of the toner base particle dispersion is preferably adjusted to a pH that impedes the progress of condensation by the organosilicon compound. Because the pH that impedes the progress of condensation by the organosilicon compound varies with the particular substance, within ±0.5 centered on the pH at which the reaction is most impeded is preferred.

The use is preferred of an organosilicon compound that has been subjected to a hydrolysis treatment. For example, hydrolysis may be carried out in advance in a separate vessel as a pretreatment for the organosilicon compound. The charge concentration for hydrolysis, using 100 mass parts for the amount of the organosilicon compound, is preferably from 40 mass parts to 500 mass parts and more preferably from 100 mass parts to 400 mass parts of water from which the ionic fraction has been removed, for example, deionized water or RO water. The conditions during hydrolysis are preferably a pH of 2 to 7, a temperature of 15° C. to 80° C., and a time of 30 to 600 minutes.

The resulting hydrolysis solution is mixed with the toner base particle dispersion and adjustment is carried out to a pH suitable for condensation (preferably 6 to 12 or 1 to 3 and more preferably 8 to 12). Formation of the protrusion shape is facilitated by adjusting the amount of the hydrolysis solution to from 5.0 mass parts to 30.0 mass parts of the organosilicon compound per 100 mass parts of the toner base particle. The condensation temperature and time during protrusion shape formation are preferably maintenance for 60 minutes to 72 hours at 35° C. to 99° C.

Adjustment of the pH is preferably carried out in two stages considering control of the protrusion shape on the toner particle surface. The protrusion shape on the toner particle surface can be controlled by carrying out condensation of the organosilicon compound with suitable adjustment of the holding time prior to adjustment of the pH and the holding time prior to the second stage adjustment of the pH. For example, preferably holding is carried out for 0.5 hours to 1.5 hours at a pH of 4.0 to 6.0 followed by holding for 3.0 hours to 5.0 hours at a pH of 8.0 to 11.0. The protrusion shape can also be controlled by adjusting the condensation temperature for the organosilicon compound in the range from 35° C. to 80° C.

For example, the protrusion width w can be controlled using, e.g., the amount of addition of the organosilicon compound, the reaction temperature, the reaction pH in the first stage, and the reaction time. For example, the protrusion width tends to increase as the reaction time in the first stage is extended.

The protrusion diameter D and protrusion height H can be controlled through, e.g., the amount of addition of the organosilicon polymer, the reaction temperature, and the second stage pH. For example, the protrusion diameter D and protrusion height H tend to increase as the reaction pH in the second stage is increased.

Specific toner production methods are described in the following, but this is not intended as a limitation to or by these.

Preferably the toner base particle is produced in an aqueous medium and the organosilicon polymer-containing protruded portions are formed on the surface of the toner base particle.

The suspension polymerization method, dissolution suspension method, and emulsion aggregation method are preferred methods for producing the toner base particle, with suspension polymerization being more preferred thereamong. The suspension polymerization method facilitates a uniform deposition of the organosilicon polymer on the surface of the toner base particle, supports an excellent adherence by the organosilicon polymer, and provides an excellent environmental stability, an excellent suppression of charge inversion components, and an excellent persistence of the preceding during extended use. The suspension polymerization method is further described in the following.

The toner base particle is obtained in the suspension polymerization method by granulating, in an aqueous medium, a polymerizable monomer composition that contains polymerizable monomer that can produce a binder resin, plus optional additives such as colorant, and then polymerizing the polymerizable monomer present in the polymerizable monomer composition.

The polymerizable monomer composition may also optionally contain a release agent as well as other resins. After completion of the polymerization step, the produced particles can be washed and recovered by filtration using known methods. The temperature may be raised in the latter half of the polymerization step. In order to remove unreacted polymerizable monomer and secondary products, a portion of the dispersion medium may also be distilled from the reaction system in the latter half of the polymerization step or after the completion of the polymerization step.

Preferably the organosilicon polymer protruded portions are formed using the method described above and the thusly obtained toner base particle.

A release agent may be used in the toner. This release agent can be exemplified by the following:

petroleum-based waxes such as paraffin waxes, microcrystalline waxes, and petrolatum, and derivatives thereof; montan wax and derivatives thereof; hydrocarbon waxes produced by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; fatty acids such as stearic acid and palmitic acid, and their acid amides, esters, and ketones; hydrogenated castor oil and derivatives thereof; as well as plant waxes, animal waxes, and silicone resins.

The derivatives include oxides as well as block copolymers and graft modifications with vinyl monomers. A single release agent may be used, or a mixture of a plurality of release agents may be used.

The release agent content, considered per 100 mass parts of the binder resin or polymerizable monomer that produces the binder resin, is preferably from 2.0 mass parts to 30.0 mass parts.

For example, the following resins may be used as the other resins:

homopolymers of styrene or a derivative thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosin, modified rosin, terpene resins, phenolic resins, aliphatic hydrocarbon resins, alicyclic hydrocarbon resins, and aromatic petroleum resins. A single one of these may be used, or a mixture of a plurality may be used.

The following vinyl polymerizable monomers are advantageous examples of the polymerizable monomer:

styrene; styrene derivatives such as α-methylstyrene, β-methylstyrene, o-methylstyrene, m-methylstyrene, p-methylstyrene, 2,4-dimethyl styrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

Among these vinyl monomers, styrene, styrene derivatives, acrylic polymerizable monomers, and methacrylic polymerizable monomers are preferred.

A polymerization initiator may be added to the polymerization of the polymerizable monomer. The following are examples of the polymerization initiator:

azo and diazo polymerization initiators such as 2,2'-azobis (2,4-divaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

These polymerization initiators are preferably added at 0.5 mass parts to 30.0 mass parts per 100 mass parts of the polymerizable monomer, and a single polymerization initiator may be used or a plurality may be used in combination.

A chain transfer agent may be added to polymerization of the polymerizable monomer in order to control the molecular weight of the binder resin that constitutes the toner base particle. The preferred amount of addition is 0.001 mass parts to 15.000 mass parts per 100 mass parts of the polymerizable monomer.

A crosslinking agent may be added to polymerization of the polymerizable monomer in order to control the molecular weight of the binder resin that constitutes the toner base particle. The following are examples:

divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, the diacrylates of polyethylene glycol #200, #400, and #600, dipropylene glycol diacrylate, polypropylene glycol diacrylate, polyester-type diacrylates (MANDA, Nippon Kayaku Co., Ltd.), and crosslinking agents provided by changing the acrylate in the preceding to methacrylate.

Polyfunctional crosslinking monomers can be exemplified by the following: pentaerythritol triacrylate, trimethylolethane triacrylate, trimethylolpropane triacrylate, tetramethylolmethane tetraacrylate, oligoester acrylates and their methacrylates, 2,2-bis(4-methacryloxy.polyethoxyphenyl) propane, diacryl phthalate, triallyl cyanurate, triallyl isocyanurate, triallyl trimellitate, and diallyl chlorendate.

The preferred amount of addition is 0.001 mass parts to 15.000 mass parts per 100 mass parts of the polymerizable monomer.

When the medium used in the aforementioned suspension polymerization is an aqueous medium, the following may be used as a dispersion stabilizer for the particles of the polymerizable monomer composition:

tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The following are examples of organic dispersing agents: polyvinyl alcohol, gelatin, methyl cellulose, methyl hydroxypropyl cellulose, ethyl cellulose, the sodium salt of carboxymethyl cellulose, and starch.

A commercially available nonionic, anionic, or cationic surfactant may also be used. These surfactants are exemplified by the following: sodium dodecyl sulfate, sodium tetradecyl sulfate, sodium pentadecyl sulfate, sodium octyl sulfate, sodium oleate, sodium laurate, and potassium stearate.

A colorant may be used in the toner; there are no particular limitations on the colorant and known colorants may be used.

The colorant content, per 100 mass parts of the binder resin or polymerizable monomer that can produce the binder resin, is preferably from 3.0 mass parts to 15.0 mass parts.

A charge control agent may be used during toner production, and a known charge control agent can be used. The amount of addition of the charge control agent is preferably 0.01 mass parts to 10.00 mass parts per 100 mass parts of the binder resin or polymerizable monomer.

The toner particle as such may be used as a toner, or any of various organic or inorganic fine powders may be externally added to the toner particle. Considering the durability when added to the toner particle, a particle diameter that is equal to or less than one-tenth the weight-average particle diameter of the toner particle is preferred for this organic or inorganic fine powder.

The following, for example, are used for the organic or inorganic fine powder.

(1) Flowability-imparting agents: silica, alumina, titanium oxide, carbon black, and fluorinated carbon.

(2) Abrasives: metal oxides (for example, strontium titanate, cerium oxide, alumina, magnesium oxide, chromium oxide), nitrides (for example, silicon nitride), carbides (for example, silicon carbide), metal salts (for example, calcium sulfate, barium sulfate, calcium carbonate).

(3) Lubricants: fluororesin powders (for example, vinylidene fluoride, polytetrafluoroethylene), metal salts of fatty acids (for example, zinc stearate, calcium stearate).

(4) Charge control particles: metal oxides (for example, tin oxide, titanium oxide, zinc oxide, silica, alumina), carbon black.

The organic or inorganic fine powder may be subjected to a surface treatment in order to improve toner flowability and provide a more uniform toner charging. The treatment agent for performing a hydrophobic treatment on the organic or inorganic fine powder can be exemplified by unmodified silicone varnishes, various modified silicone varnishes, unmodified silicone oils, various modified silicone oils, silane compounds, silane coupling agents, organosilicon compounds other than the preceding, and organotitanium compounds. A single one of these treatment agents may be used or a plurality may be used in combination.

The measurement methods involved with the present invention are described in the following.

Method for Observing Toner Cross Section with Scanning Transmission Electron Microscope (STEM)

The toner cross section for observation with a scanning transmission electron microscope (STEM) is prepared proceeding as follows.

The procedure for preparing the toner cross section is described in the following.

The toner is first broadcast into a single layer on a cover glass (square cover glass, Square No. 1, Matsunami Glass Ind., Ltd.), and an Os film (5 nm) and a naphthalene film (20 nm) are executed thereon as protective films using an Osmium Plasma Coater (OPC80T, Filgen, Inc.).

D800 photocurable resin (JEOL Ltd.) is then filled into a PTFE tube (inner diameter 1.5 mmØ×outer diameter 3 mmØ×3 mm), and the aforementioned cover glass is gently placed on the tube with the toner facing so as to come into contact with the D800 photocurable resin. This assembly is exposed to light and the resin is cured, followed by removal of the cover glass and tube to produce a resin cylinder in which the toner is embedded in the outermost surface side.

Using an ultrasound ultramicrotome (UC7, Leica), cross sections of the center of the toner are generated by slicing, from the surface most side of the resin cylinder at a slicing rate of 0.6 mm/s, at just the length of the radius of the toner (for example, 4.0 μm when the weight-average particle diameter (D4) is 8.0 μm).

Thin-section samples of the toner cross section are then prepared by slicing at a film thickness of 100 nm. Cross sections of the center of the toner can be obtained by slicing in accordance with this procedure.

An image is acquired using a STEM probe size of 1 nm and an image size of 1024×1024 pixels. The image is acquired by adjusting the Contrast to 1425 and the Brightness to 3750 on the Detector Control panel for the bright-field image and adjusting the Contrast to 0.0, the Brightness to 0.5, and the Gamma to 1.00 on the Image Control panel. Image magnification is 100,000×, and image acquisition is performed so as to fit approximately from one-fourth to one-half of the circumference of the cross section for one toner particle, as shown in FIG. 1.

The organosilicon polymer-containing protruded portions are measured by subjecting the obtained image to image processing using image processing software (Image J (available from https://imagej.nih.gov/ij/)). Image processing is carried out on 30 STEM images.

First, a line is drawn along the circumference of the toner base particle using the line drawing tool (select Segmented line on the Straight tab). In regions where the organosilicon polymer protruded portion is embedded in the toner base particle, the lines are smoothly connected as if this embedding did not occur.

Conversion to a flat image is performed based on this line (select Selection on the Edit tab and convert the line width to 500 pixels using properties, then select Selection on the Edit tab and perform Straightener). Using the methodology described above, the protrusion width w, protrusion diameter D, and protrusion height H are measured at each individual location of an organosilicon polymer-containing protruded portion in the flat image. P(D/w) is calculated from the measurement results for the 30 STEM images. The cumulative distribution of the protrusion height H is also generated and H80 is calculated.

In addition, Σw is used for the sum of the protrusion widths w of the protruded portions having a protrusion height H from 40 nm to 300 nm, that are present in the flat image used for image analysis, and the circumference length L is used for the width of the flat image used for image processing. This width of the flat image corresponds to the length of the surface of the toner base particle in the STEM image. Σw/L is calculated for a single image, and the arithmetic mean value over the 30 STEM images is used.

The details of measurement of the protruded portions are as indicated in the preceding description and FIG. 2 to FIG. 4.

The measurement is performed after overlaying the scale on the image with Straight Line in the Straight tab in ImageJ and setting the length of the scale on the image using Set Scale in the Analyze tab. The line segments corresponding to the protrusion width w and the protrusion height H are drawn with Straight Line in the Straight tab, and the measurement can be performed using Measure in the Analyze tab.

Method for Calculating Average Particle Diameter of Protruded Portions Using Scanning Electron Microscope (SEM)

The SEM observation procedure is as follows. This is carried out using the image taken with an S-4800 Hitachi ultrahigh resolution field emission scanning electron microscope (Hitachi High-Technologies Corporation). The image acquisition conditions using the S-4800 are as follows.

(1) Specimen Preparation

A conductive paste (Product No. 16053, PELCO Colloidal Graphite, Isopropanol Base, TED PELLA, Inc.) is thinly coated on the specimen stand (15 mm×6 mm aluminum sample stand) and the toner is sprayed onto this. After the excess toner have been removed from the specimen stand using an air blower, platinum vapor deposition is carried out for 15 seconds at 15 mA. The specimen stand is set in the specimen holder and the specimen stand height is adjusted to 30 mm using the specimen height gauge.

(2) Setting Conditions for Observation with S-4800

Liquid nitrogen is introduced to the brim of the anti-contamination trap attached to the S-4800 housing and standing for 30 minutes is carried out. The "PC-SEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [2.0 kV] and the emission current is set to [10 μA]. In the [base] tab of the operation panel, signal selection is set to [SE]; [lower (L)] is selected for the SE detector; and the instrument is placed in backscattered electron image observation mode. Similarly, in the [base] tab of the operation panel, the probe current of the electron optical system condition block is set to [Normal]; the focus mode is set to [UHR]; and WD is set to [8.0 mm]. The [ON] button in the acceleration voltage display area of the control panel is pressed to apply the acceleration voltage.

(3) Focus Adjustment

The magnification is set to 5,000× (5 k) by dragging within the magnification display area of the control panel. Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel.

[aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. Focusing is performed by repeating this operation an additional two times. With the center of the major diameter of the observed particle adjusted to the center of the measurement screen, the magnification is set to 10,000× (10 k) by dragging within the magnification display area of the control panel. Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel.

[aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. The magnification is then set to 50,000× (50 k); focus adjustment is performed as above using the focus knob and the STIGMA/ALIGNMENT knobs; and re-focusing is performed using autofocus. This operation is repeated to achieve focus.

(4) Image Storage

Brightness adjustment is performed using the ABC mode and a photograph with a size of 640×480 pixels is taken and saved.

Using the obtained SEM image, the number-average diameter (Dl) of the at least 20-nm protruded portions present at 500 locations on the toner particle surface is calculated using the image processing software (ImageJ). The measurement method is as follows.

Measurement of Number-average Diameter of Protruded Portions of Organosilicon Polymer The protruded portions and toner base particle in the image are binarized and color-discriminated by particle analysis. From among the measurement commands, the largest diameter of the selected shape is then selected and the protrusion diameter R (maximum diameter) of the protruded portion at one location is measured. This operation is carried out a plurality of times, and the number-average diameter is calculated for the protrusion diameter R by determining the arithmetic average value for 500 locations.

Method for Measuring Fixing Ratio of Organosilicon Polymer

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.)

are introduced into a centrifugal separation tube (50 mL volume) to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL volume) for swing rotor service, and separation is performed with a centrifugal separator (H-9R, Kokusan Co., Ltd.) using conditions of 3,500 rpm and 30 minutes. Satisfactory separation of the toner from the aqueous solution is checked visually, and the toner separated into the uppermost layer is recovered with, for example, a spatula. The aqueous solution containing the recovered toner is filtered on a vacuum filter and then dried for at least 1 hour in a dryer. The dried product is crushed with a spatula and the amount of silicon is measured by x-ray fluorescence. The fixing ratio (%) is calculated from the ratio for the amount of the measured element between the post-water-wash toner and the starting toner.

Measurement of the x-ray fluorescence of the particular element is based on JIS K 0119-1969 and is specifically as follows.

An "Axios" wavelength-dispersive x-ray fluorescence analyzer (PANalytical B.V.) is used as the measurement instrumentation, and the "SuperQ ver. 4.0F" (PANalytical B.V.) software provided with the instrument is used in order to set the measurement conditions and analyze the measurement data. Rh is used for the x-ray tube anode; a vacuum is used for the measurement atmosphere; the measurement diameter (collimator mask diameter) is 10 mm; and the measurement time is 10 seconds. Detection is carried out with a proportional counter (PC) in the case of measurement of the light elements, and with a scintillation counter (SC) in the case of measurement of the heavy elements.

Approximately 1 g of the starting toner or post-water-wash toner is introduced into a specialized aluminum compaction ring with a diameter of 10 mm and is smoothed over, and, using a "BRE-32" tablet compression molder (Maekawa Testing Machine Mfg. Co., Ltd.), a pellet is produced by molding to a thickness of approximately 2 mm by compression for 60 seconds at 20 MPa, and this pellet is used as the measurement sample.

The measurement is performed using the conditions indicated above and the elements are identified based on the positions of the resulting x-ray peaks; their concentrations are calculated from the count rate (unit: cps), which is the number of x-ray photons per unit time.

To quantitate, for example, the amount of silicon in the toner, for example, 0.5 mass parts of silica ($SiO_2$) fine powder is added to 100 mass parts of the toner particle and thorough mixing is performed using a coffee mill. 2.0 mass parts and 5.0 mass parts of the silica fine powder are each likewise mixed with the toner particle, and these are used as samples for calibration curve construction.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis.

The toner to be analyzed is then made into a pellet proceeding as above using the tablet compression molder and is subjected to measurement of its Si-Kα radiation count rate. The content of the organosilicon polymer in the toner is determined from the aforementioned calibration curve. The ratio of the amount of the element in the post-water-wash toner to the amount of the element in the starting toner calculated by this method is determined and is used as the fixing ratio (%).

EXAMPLES

The present invention is specifically described below using examples, but the present invention is not limited to or by these examples. Unless specifically indicated otherwise, the "parts" used for the materials in the examples and comparative examples is on a mass basis in all instances.

Toner 1 Production Example

Aqueous Medium 1 Preparation Step 14.0 parts of sodium phosphate (decahydrate, RASA Industries, Ltd.) was introduced into 650.0 parts of deionized water in a reactor fitted with a stirrer, thermometer, and reflux condenser, and this was held for 1.0 hour at 65° C. while purging with nitrogen.

An aqueous calcium chloride solution of 9.2 parts of calcium chloride (dihydrate) dissolved in 10.0 parts of deionized water was introduced all at once while stirring at 15,000 rpm using a T. K. Homomixer (Tokushu Kika Kogyo Co., Ltd.) to prepare an aqueous medium containing a dispersion stabilizer. 10 mass % hydrochloric acid was introduced into the aqueous medium to adjust the pH to 5.0, thus yielding aqueous medium 1.

Step of Preparing Polymerizable Monomer Composition styrene: 60.0 parts

C. I. Pigment Blue 15:3:6.5 parts

These materials were introduced into an attritor (Mitsui Miike Chemical Engineering Machinery Co., Ltd.) and dispersion was carried out for 5.0 hours at 220 rpm using zirconia particles with a diameter of 1.7 mm to prepare a pigment dispersion.

The following materials were added to this pigment dispersion.

styrene: 20.0 parts n-butyl acrylate: 20.0 parts crosslinker (divinylbenzene): 0.3 parts saturated polyester resin: 5.0 parts (polycondensate of propylene oxide-modified bisphenol A (2 mol adduct) and terephthalic acid (10:12 molar ratio), glass transition temperature Tg=68° C., weight-average molecular weight Mw=10,000, molecular weight distribution Mw/Mn=5.12)

Fischer-Tropsch wax (melting point: 78° C.): 7.0 parts

This was held at 65° C. and a polymerizable monomer composition was prepared by dissolving and dispersing to uniformity at 500 rpm using a T. K. Homomixer (Tokushu Kika Kogyo Co., Ltd.).

Granulation Step

While holding the temperature of aqueous medium 1 at 70° C. and the rotation rate of the T. K. Homomixer at 15,000 rpm, the polymerizable monomer composition was introduced into the aqueous medium 1 and 10.0 parts of the polymerization initiator t-butyl peroxypivalate was added. Granulation was performed for 10 minutes while maintaining 15,000 rpm with the stirrer.

Polymerization.Distillation Step

After the granulation step, the stirrer was changed over to a propeller impeller and polymerization was carried out for 5.0 hours while maintaining 70° C. and stirring at 150 rpm. The temperature was then raised to 85° C. and the polymerization reaction was run for 2.0 hours while heating.

The reflux condenser on the reactor was subsequently changed over to a condenser, and distillation was performed for 6 hours by heating the slurry to 100° C., thereby distilling off the unreacted polymerizable monomer and yielding a toner base particle dispersion.

Polymerization of Organosilicon Compound 60.0 parts of deionized water was metered into a reactor fitted with a stirrer and thermometer and the pH was adjusted to 4.0 using 10 mass % hydrochloric acid. This was heated while being stirred to bring the temperature to 40° C. 40.0 parts of the organosilicon compound methyltriethoxysilane was then added and a hydrolysis was carried out for at least 2 hours while stirring. The end point of the hydrolysis was confirmed by visual observation when oil/water separation was not occurring and one layer was present; cooling then yielded an organosilicon compound hydrolysis solution.

After the obtained toner base particle dispersion had been cooled to 55° C., 25.0 parts of the organosilicon compound hydrolysis solution was added and polymerization of the organosilicon compound was initiated. Holding in this condition was carried out for 15 minutes, followed by adjustment of the pH to 5.5 using a 3.0% aqueous sodium bicarbonate solution. Holding was carried out for 60 minutes while continuing to stir at 55° C., after which the pH was adjusted to 9.5 using a 3.0% aqueous sodium bicarbonate solution followed by an additional holding for 240 minutes to obtain a toner particle dispersion.

Washing and Drying Step

After the completion of the polymerization step, the toner particle dispersion was cooled; hydrochloric acid was added to the toner particle dispersion to adjust the pH to 1.5 or below; holding was carried out for 1 hour while stirring; and solid/liquid separation was performed on a pressure filter to obtain a toner cake. This was reslurried with deionized water to provide another dispersion, followed by solid/liquid separation on the aforementioned filter to obtain a toner cake.

The resulting toner cake was dried over 72 hours in a thermostatted chamber at 40° C. and was classified to obtain a toner particle 1. The conditions for the production of toner particle 1 are given in Table 1.

TABLE 1

| toner particle | type of organosilicon | amount of | holding | condensation reaction 1 | | condensation reaction 2 | | temperature | |
|---|---|---|---|---|---|---|---|---|---|
| No. | compound | addition | time | pH | time | pH | time | ° C. | remarks |
| 1 | methyltriethoxysilane | 10 | 0.25 | 5.5 | 1.0 | 9.5 | 4.0 | 55 | |
| 2 | methyltriethoxysilane | 12 | 0.25 | 5.5 | 1.0 | 9.5 | 4.0 | 55 | |
| 3 | methyltriethoxysilane | 16 | 0.25 | 5.5 | 1.0 | 9.5 | 4.0 | 55 | |
| 4 | methyltriethoxysilane | 10 | 0.25 | 7.0 | 1.5 | 9.5 | 3.5 | 55 | |
| 5 | methyltriethoxysilane | 12 | 0.25 | 7.0 | 1.5 | 9.5 | 3.5 | 55 | |
| 6 | methyltriethoxysilane | 16 | 0.25 | 7.0 | 1.5 | 9.5 | 3.5 | 55 | |
| 7 | methyltriethoxysilane | 12 | 0.25 | 7.0 | 3.5 | 9.5 | 1.5 | 55 | |
| 8 | methyltriethoxysilane | 16 | 0.25 | 4.0 | 1.0 | 9.5 | 3.5 | 55 | |
| 9 | methyltriethoxysilane | 16 | 0.25 | 4.0 | 2.0 | 9.5 | 3.0 | 55 | |
| 10 | methyltrimethoxysilane | 10 | 0.50 | 5.5 | 1.0 | 9.5 | 4.0 | 55 | |
| 11 | methyltriethoxysilane/ tetraethoxysilane | 9.5/0.5 | 0.50 | 5.5 | 1.0 | 9.5 | 4.0 | 55 | |
| 12 | methyltriethoxysilane/ vinyltriethoxysilane | 9.0/1.0 | 0.50 | 5.5 | 1.0 | 9.5 | 4.0 | 55 | |
| C.1 | methyltriethoxysilane | 5 | 1.00 | 9.5 | 5.0 | — | — | 70 | sol-gel silica was also used when the organosilicon compound was added |
| C.2 | 3-(methacryloxy) propyltrimethoxysilane | 30 | 5.00 | 9.5 | 10.0 | — | — | 70 | |
| C.3 | none used | | — | — | — | — | — | — | no organosilicon compound was used |

In the table, "C." denotes comparative, the unit for time is h, and the "amount of addition" is the amount of addition (parts) of the organosilicon compound in the step of polymerizing the organosilicon compound.

Toner Particle 2 to 12 Production Methods

Toner particles 2 to 12 were obtained proceeding as for toner particle 1, but changing to the conditions shown in Table 1.

Comparative Toner Particle 1 Production Method

Comparative toner particle 1 was obtained proceeding as for toner particle 1, but changing the polymerization of the organosilicon compound as indicated in the following.

Polymerization of Organosilicon Compound 60.0 parts of deionized water was metered into a reactor fitted with a stirrer and thermometer and the pH was adjusted to 4.0 using 10 mass % hydrochloric acid. This was heated while being stirred to bring the temperature to 40° C. 40.0 parts of the organosilicon compound methyltriethoxysilane was then added and a hydrolysis was carried out for at least 2 hours while stirring. The end point of the hydrolysis was confirmed by visual observation when oil/water separation was not occurring and one layer was present; cooling then yielded an organosilicon compound hydrolysis solution.

The temperature of the resulting toner base particle dispersion was cooled to 70° C. and the pH was then adjusted to 9.5 with a 3.0% aqueous sodium bicarbonate solution. While continuing to stir at 70° C., 5.0 parts of a colloidal silica (Snowtex ST-ZL, solids fraction=40%) and 12.5 parts of the organosilicon compound hydrolysis solution were added and polymerization of the organosilicon compound was initiated. This was held as such for 300 minutes to obtain a toner particle dispersion.

Comparative Toner Particle 2 Production Method

Comparative toner particle 2 was obtained proceeding as for toner particle 1, but changing the polymerization of the organosilicon compound as indicated in the following.

Polymerization of Organosilicon Compound

A mixed medium was prepared by the dissolution of 1.0 parts of polyvinyl alcohol in 20 parts of a mixed solvent of ethanol/water=1:1 (mass ratio), and this mixed medium was dispersed in the toner base particle dispersion. 30 parts of the silicon compound 3-(methacryloxy)propyltrimethoxysilane was then dissolved and stirring was carried out for an additional 5 hours to induce swelling and incorporation within the toner particle by the 3-(methacryloxy)propyltrimethoxysilane.

Then, after the temperature had been brought to 70° C., the pH was adjusted to 9.5 with a 3.0% aqueous sodium bicarbonate solution. A sol-gel reaction was developed at the toner particle surface by stirring at room temperature for 10 hours, thus yielding the comparative toner particle 2.

Comparative Toner Particle 3 Production Method

A comparative toner particle 3 was obtained by not carrying out the organosilicon compound polymerization in the production example for toner particle 1.

Example 1

Toner particle 1 was used as such as toner 1, and the following durability evaluations of the transferability and member contamination were carried out. The results are given in Table 2.

TABLE 2

| | toner | results of analysis of the STEM image | | | | results of x-ray fluorescence analysis | |
|---|---|---|---|---|---|---|---|
| | particle No. | P(D/w) number % | ΣW/L | H80 nm | R nm | silicon amount (mass %) | fixing ratio % |
| toner 1 | 1 | 89% | 0.61 | 75 | 45 | 3.5 | 99 |
| toner 2 | 2 | 85% | 0.60 | 80 | 40 | 4.3 | 98 |
| toner 3 | 3 | 82% | 0.64 | 85 | 45 | 5.3 | 97 |
| toner 4 | 4 | 76% | 0.33 | 80 | 30 | 3.6 | 99 |
| toner 5 | 5 | 72% | 0.40 | 85 | 35 | 4.4 | 98 |
| toner 6 | 6 | 73% | 0.42 | 90 | 40 | 5.4 | 95 |
| toner 7 | 7 | 90% | 0.30 | 90 | 25 | 4.4 | 91 |
| toner 8 | 8 | 95% | 0.83 | 75 | 60 | 5.4 | 84 |
| toner 9 | 9 | 85% | 0.91 | 70 | 65 | 5.3 | 94 |
| toner 10 | 10 | 90% | 0.62 | 80 | 40 | 3.4 | 94 |
| toner 11 | 11 | 87% | 0.45 | 90 | 40 | 3.5 | 92 |
| toner 12 | 12 | 95% | 0.85 | 70 | 55 | 3.4 | 99 |
| comparative toner 1 | C. 1 | 0% | 0.75 | 65 | 60 | 5.3 | 92 |
| comparative toner 2 | C. 2 | 20% | 0.20 | 45 | 30 | 3.5 | 78 |
| comparative toner 3 | C. 3 | 40% | 0.20 | 75 | 180 | 4.4 | 68 |
| comparative toner 4 | C. 3 | 0% | 0.30 | 60 | 80 | 4.2 | 85 |

In the table, "C." denotes comparative, and "R" denotes number-average diameter for protrusion diameter R (nm).

Durability Evaluation Method

An LBP7700C, a commercial laser printer from Canon, Inc., was used in modified form. The modification consisted of providing the developing roller with a rotation velocity of 360 mm/sec by changing the main unit of the evaluation machine and changing the software.

The toner was filled into a toner cartridge for the LBP7700C, and this toner cartridge was held for 24 hours in a normal-temperature, normal-humidity NN (25° C./50% RH) environment. After standing for 24 hours in this environment, the toner cartridge was installed in the aforementioned machine.

To evaluate the transferability and member contamination, 7,500 prints of an image with a print percentage of 5.0% were printed out in the NN environment in the crosswise direction at the center of A4 paper with a 50-mm margin on both the left and right. The evaluations were performed after the initial print and after the output of 7,500 prints.

Evaluation of Transferability

The transferability (untransferred density) was evaluated as follows. A solid image was output, and the untransferred toner on the photosensitive member during formation of the solid image was peeled off by taping using a transparent polyester adhesive tape. A density difference was calculated by subtracting, from the density for the peeled-off adhesive tape pasted on paper, the density of only the adhesive tape pasted on paper. The density measurement was carried out at five locations and the average value was determined. This density difference value was graded as follows.

The density was measured using an X-Rite color reflection densitometer (X-Rite 500 Series, X-Rite, Incorporated). A C or better was regarded as excellent.

Evaluation Criteria

A: the density difference is less than 0.030

B: the density difference is at least 0.030, but less than 0.050

C: the density difference is at least 0.050, but less than 0.100

D: the density difference is equal to or greater than 0.100

Evaluation of Member Contamination

Member contamination (solid/halftone gradation stability) was evaluated as follows.

An image-checking drum unit was first prepared. A charging roller for toner evaluation was then installed at the image-checking drum unit and image output was performed. For the image, an image was prepared in which a halftone was printed over the entire side. The density was measured, on the image provided by durability testing, in the central area of the halftone image and in the 50-mm margins on the right and left, and the evaluation was performed based on the density difference between the margin area and the central area.

It is known that non-uniform charging is produced on the photosensitive member when charging member contamination is produced and that image density non-uniformity is then produced in the halftone (HT) image.

The density was measured using an X-Rite color reflection densitometer (X-Rite 500 Series, X-Rite, Incorporated). A C or better was regarded as excellent.

Evaluation Criteria

A: the density difference for the halftone after the output of 7,500 prints is less than 0.030

B: the density difference for the halftone after the output of 7,500 prints is at least 0.030, but less than 0.050

C: the density difference for the halftone after the output of 7,500 prints is at least 0.050, but less than 0.100

D: the density difference for the halftone after the output of 7,500 prints is equal to greater than 0.100

The results of the durability evaluations of toner 1 are given in Table 3.

TABLE 3

| | | evaluation of transferability | | | | evaluation of member contamination | |
|---|---|---|---|---|---|---|---|
| | | initial | | after 7,500 prints | | after 7,500 prints | |
| Example No. | toner No. | untransferred density | score | untransferred density | score | HT density non-uniformity | score |
| 1 | 1 | 0.016 | A | 0.022 | A | 0.012 | A |
| 2 | 2 | 0.014 | A | 0.024 | A | 0.016 | A |
| 3 | 3 | 0.012 | A | 0.024 | A | 0.012 | A |
| 4 | 4 | 0.016 | A | 0.078 | C | 0.040 | B |
| 5 | 5 | 0.012 | A | 0.032 | B | 0.070 | C |
| 6 | 6 | 0.006 | A | 0.062 | C | 0.080 | C |
| 7 | 7 | 0.014 | A | 0.062 | C | 0.034 | B |
| 8 | 8 | 0.024 | A | 0.032 | B | 0.019 | A |
| 9 | 9 | 0.034 | B | 0.042 | B | 0.011 | A |
| 10 | 10 | 0.016 | A | 0.022 | A | 0.020 | A |
| 11 | 11 | 0.016 | A | 0.022 | A | 0.040 | B |
| 12 | 12 | 0.032 | B | 0.042 | B | 0.032 | B |
| C. E. 1 | C. 1 | 0.020 | A | 0.102 | D | 0.118 | D |
| C. E. 2 | C. 2 | 0.150 | D | 0.370 | D | 0.276 | D |
| C. E. 3 | C. 3 | 0.098 | C | 0.350 | D | 0.306 | D |
| C. E. 4 | C. 4 | 0.052 | C | 0.506 | D | 0.324 | D |

In the table, "C." denotes comparative, and "C. E." denotes Comparative Example.

Evaluation of Toners 2 to 12 and Comparative Toners 1 to 4

Toner particles 2 to 12 and comparative toner particles 1 and 2 were used as such as toners 2 to 12 and comparative toners 1 and 2, and the evaluations were performed thereon.

For comparative toners 3 and 4, the toners were prepared by carrying out external addition on comparative toner particle 3 using the following conditions, followed by the evaluations.

Production of Comparative Toner 3

An organosilicon fine particle A was first synthesized as described in the following.

An aqueous solution was prepared by introducing 500 g of deionized water into a reactor and adding 0.2 g of a 48% aqueous sodium hydroxide solution. To this aqueous solution were added 65 g of methyltrimethoxysilane and 50 g of tetraethoxysilane; a hydrolysis reaction was run for 1 hour while holding the temperature at 13° C. to 15° C.; 2.5 g of a 20% aqueous solution of sodium dodecylbenzenesulfonate was added; and a hydrolysis reaction was run for 3 hours at the same temperature. A transparent, silanol compound-containing reaction product was obtained in approximately 4 hours.

A condensation reaction was then run for 5 hours while holding the temperature of the obtained reaction product at 70° C., to obtain an aqueous suspension that contained fine particles of an organosilicon compound. This aqueous suspension was filtered on a membrane filter; the filtrate was provided to a centrifugal separator; and white fine particles were separated. The separated white fine particles were washed with water and were subjected to hot-air drying for 5 hours at 150° C. to obtain organosilicon fine particle A.

Observation of organosilicon fine particle A with a scanning electron microscope showed that this organosilicon fine particle A was a hollow hemispherical body, and calculation by image analysis of the number-average particle diameter (μm) for the long diameter and short diameter of the hemisphere gave 180 nm for the long diameter and 80 nm for the short diameter.

3.0 parts of organosilicon fine particle A was added to 100 parts of comparative toner particle 3 and mixing was carried out using a Henschel mixer at a peripheral velocity for the stirring blade of 20 m/s. Comparative toner 3 was then prepared by mixing, using a Henschel mixer at a peripheral velocity for the stirring blade of 20 m/s, 1.5 parts of a hexamethyldisilazane-treated hydrophobic silica having a number-average particle diameter of 12 nm.

Production of Comparative Toner 4

Comparative toner 4 was prepared as for the preparation of comparative toner 3, but with the following changes: the organosilicon fine particle A was changed to a hydrophobic sol-gel silica (number-average particle diameter=80 nm, Nippon Aerosil Co., Ltd.), and the peripheral stirring blade velocity for the Henschel mixer was changed from 20 m/s to 40 m/s.

The analytical results for each toner are given in Table 2, and the results for the durability evaluations are given in Table 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-134368, filed Jul. 17, 2018, which is hereby incorporated by reference herein in its entirety.

What is claimed is:

1. A toner, comprising:

a toner particle that contains a toner base particle comprising a binder resin, and having an organosilicon polymer present on a surface of the toner base particle, wherein the organosilicon polymer has a structure according to R—$SiO_{3/2}$, where R represents a $C_{1-6}$ alkyl group or a phenyl group, the organosilicon polymer forms protruded portions on the toner base particle surface, and in a flat image provided by observing the toner cross section with a scanning transmission electron microscope STEM, drawing a line along the circumference of the toner base particle surface, and converting based on this line along the circumference, and assuming that the length of the line along the circumference for a segment where a protruded portion and the toner base particle form a continuous interface is taken as a protrusion width w, the maximum length of a protruded portion in the direction normal to the protrusion width w is taken as a protrusion diameter D, and the length, in the line segment that forms the protrusion diameter D, from the peak of a protruded portion to the line along the circumference is taken as a protrusion height H, the numerical proportion P(D/w), in protruded portions having a protrusion height H from 40 nm to 300 nm, of protruded portions having a ratio D/w of the protrusion diameter D to the protrusion width w from 0.33 to 0.80 is at least 70 number %.

2. The toner according to claim 1, wherein in observation of the toner cross section using a scanning transmission electron microscope STEM, Σw/L is from 0.30 to 0.90 where the width of the flat image is taken as a circumference length L and the sum of the protrusion widths w of the protruded portions having a protrusion height H from 40 to 300 nm of the protruded portions of the organosilicon polymer present in the flat image is taken as Σw.

3. The toner according to claim 1, wherein the fixing ratio of the organosilicon polymer on the toner is at least 80 mass %.

4. The toner according to claim 3, wherein the fixing ratio of the organosilicon polymer on the toner is from 80 to 99 mass %.

5. The toner according to claim 1, wherein H80 is at least 65 nm where H80 is the protrusion height corresponding to 80 number % for cumulation of the protrusion height H from the small side when a cumulative distribution of the protrusion height H is constructed for the protruded portions having a protrusion height H from 40 to 300 nm.

6. The toner according to claim 1, wherein R is said $C_{1-6}$ alkyl group.

7. The toner according to claim 1, wherein the binder resin is produced from a polymerizable monomer.

8. The toner according to claim 7, wherein the polymerizable monomer is a vinyl polymerizable monomer.

9. The toner according to claim 8, wherein the vinyl polymerizable monomer is at least one member selected from the group consisting a styrene, a styrene derivative, an acrylic polymerizable monomer and a methacrylic polymerizable monomer.

* * * * *